US005413551A

United States Patent [19]

Wu

[11] Patent Number: 5,413,551

[45] Date of Patent: May 9, 1995

[54] SPHERICAL MASSAGE DEVICE

[76] Inventor: Otto Wu, Room 918, 15 Fu Hsin N. Road, Taipei, Taiwan, Prov. of China

[21] Appl. No.: 176,843

[22] Filed: Jan. 3, 1994

[51] Int. Cl.[6] ..... A61H 1/00

[52] U.S. Cl. ..... 601/46; 601/70; 601/131

[58] Field of Search ..... 601/118, 131, 132, 134, 601/52, 67, 68, 69, 70, 121, 63, 62, 46, 65; 446/437, 3; 273/58 G

[56] References Cited

U.S. PATENT DOCUMENTS

| | | | |
|---|---|---|---|
| 744,718 | 2/1903 | Cassidy | 601/131 |
| 2,742,037 | 10/1954 | Svoren | 601/57 |
| 2,932,821 | 7/1958 | Horton | 601/46 |
| 3,453,773 | 8/1965 | Compton | 446/458 |
| 3,549,920 | 6/1969 | Tavel | 601/70 |
| 5,297,981 | 3/1994 | Maxim | 446/437 |

FOREIGN PATENT DOCUMENTS

| | | | |
|---|---|---|---|
| 3207693 | 9/1983 | Denmark | 601/78 |
| 470974 | 8/1937 | United Kingdom | 446/458 |

*Primary Examiner*—Robert A. Hafer
*Assistant Examiner*—David J. Kenealy
*Attorney, Agent, or Firm*—Morton J. Rosenberg; David I. Klein

[57] ABSTRACT

A spherical massage device includes a hollow spherical body of a size suitable to be held in hands, having a spherical outer surface on which a plurality of projections are uniformly distributed. The hollow spherical body defines an interior space inside which a vibration generator is disposed. The vibration generator is controlled by a switch accessible by a user.

5 Claims, 3 Drawing Sheets

SPHERICAL MASSAGE DEVICE

FIELD OF THE INVENTION

The invention relates generally to a massage device and in particular to a spherical massage device suitable to be held in hands to massage the hand muscles.

BACKGROUND OF THE INVENTION

Massage has been a popular treatment for relaxing strained muscle and restoring vividness of the exhausted human body. There are now available in the market a variety of massage devices for use on different parts of human body. However, there lacks a massage device particularly designed for massaging palms and fingers.

Some of the commercially available massage devices have very complicated structure and are thus expensive in cost, easy to damage and hard to repair and maintain.

It is therefore desirable to provide a massage device which is cheap in cost, simple in structure and particularly suitable to massage palms and fingers.

SUMMARY OF THE INVENTION

The principal objective of the present invention is to provide a spherical massage device having a size suitable to be held in hands for massaging palms and fingers.

It is another objective of the present invention to provide a massage device which is cheap in cost, simple in structure and particularly suitable to massage palms and fingers.

To achieve the above-mentioned objectives, there is provided a spherical massage device comprising a hollow spherical body of a size suitable to be held in hands, having a spherical outer surface on which a plurality of projections are uniformly distributed. The hollow spherical body defines an interior space inside which a vibration generator is disposed. The vibration generator is controlled by a switch accessible by a user.

BRIEF DESCRIPTION OF THE DRAWINGS

Other objectives and advantages of the invention will be apparent from the following description of a preferred embodiment of the present invention taken in connection with the accompanying drawings, wherein.

DETAILED DESCRIPTION OF THE PREFERRED EMBODIMENTS

Figure 1:
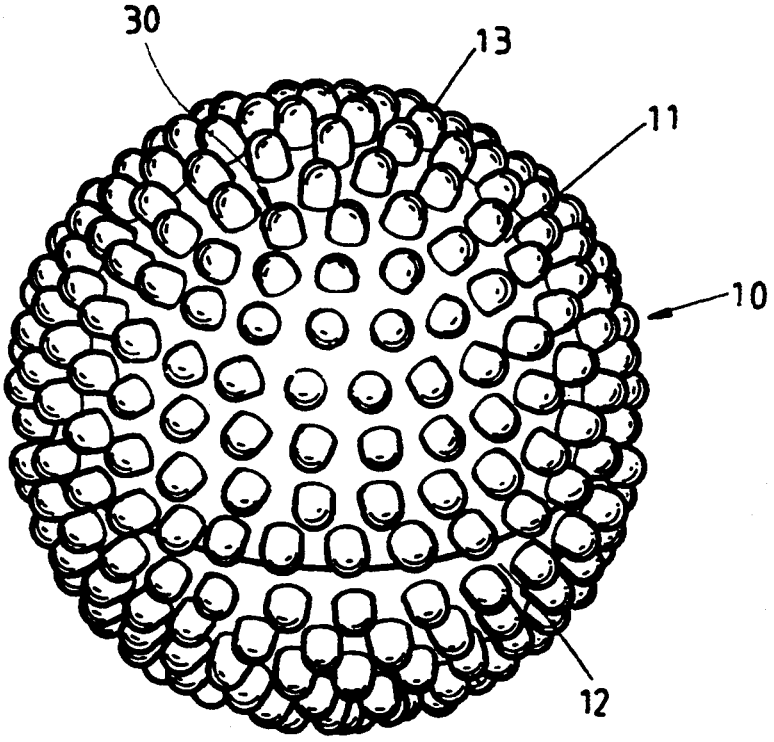
FIG. 1 is a perspective view showing a spherical massage device constructed in accordance with the present invention.

With reference to the drawings and in particular to FIG. 1, wherein a spherical massage device constructed in accordance with the present invention, generally designated with reference numeral 10, is shown, the spherical massage device 10 comprises a hollow spherical body 30 constituted by a first hemispheric shell 11 releasably secured to a second hemispheric shell 12 to define a spherical outer surface. A plurality of nipple-like projections 13 are uniformly distributed on the spherical outer surface of the spherical body 30.

Figure 2:
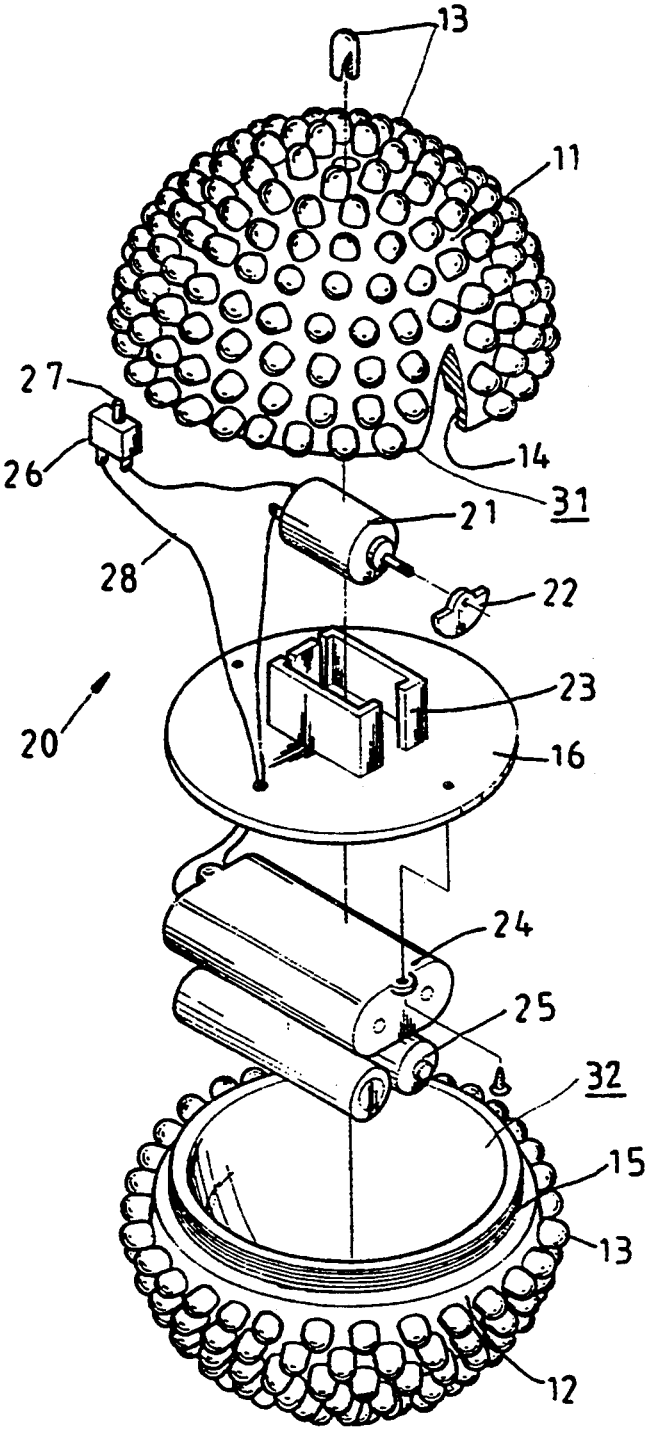
FIG. 2 is an exploded view of the spherical massage device shown in FIG. 1.

With particular reference to FIG. 2, in the embodiment illustrated, the first hemispheric shell 11 is a substantially rigid member having a lower opening 31 which has an inner thread 14 formed thereon. The second hemispheric shell 12 is also a substantially rigid member, preferably made of the same material as the first hemispheric shell 11, having an upper opening 31 which has an external thread 15 formed thereon to be engageable with the inner thread 14 of the first hemispheric shell 11 to form the spherical body 30.

Figure 3:
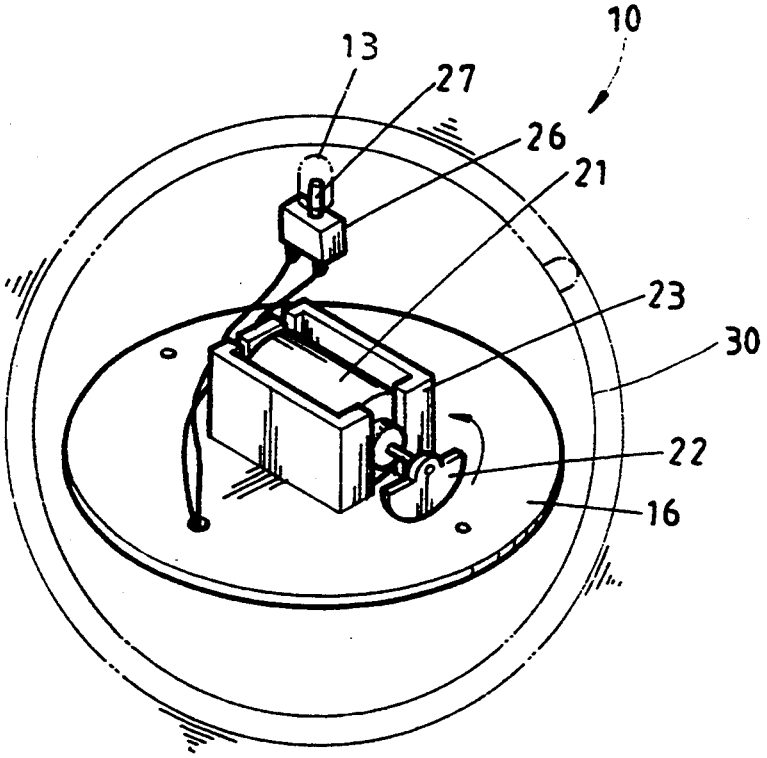
FIG. 3 is a perspective view showing the vibration generator disposed inside the spherical massage device.

Further referring to FIG. 3, a base plate 16 is disposed and secured within the hollow spherical body 30 on which vibration generator means 20 is fixed. The vibration generator means 20 comprises driver means, preferably an electrical motor 21, having an eccentric weight 22 mounted to a spindle 28 thereof to be rotated thereby to generate vibration.

Preferably, a seat 23 is provided on a top surface of the base plate 16 to securely hold the electrical motor 21 on the base plate 16.

Power source means, such as battery set 25, is secured on a bottom surface of the base plate 16 by being disposed and thus secured in a battery chamber 24 which is fixed on the bottom surface of the base plate 16. Electrical wires 28 connected between the electrical motor 21 and the battery chamber 24 are provided to transmit electricity to the electrical motor 21.

Switch means 26 is connected on the electrical wires 28 to control the supply of electricity to the electrical motor 21. Preferably, the switch means 26 comprises a switching button 27 located at such a position to be accessible by a user to allow the user to control the vibration generator means 20.

Preferably, the switching button 27 is disposed in such a way to partially project out of the hollow spherical body 30 to be accessible by the user and more preferably, the switching button 27 is located below or within one of the plurality of nipple-like projections 13 to be depressible by the user. The projection 13 below which the switching button 27 is located may be particularly marked, such as marked by different color, to indicate the location of the switching button 27.

The base plate 16 may be fixed inside the hollow spherical body 30 by any known means, such as screws or adhesives, and preferably the base plate 16 is fixed on one of the hemispheric shells 11 or 12 in such a way to allow the battery chamber 24 exposed when the shells 11 and 12 are disengaged from each other so as to allow easy change of the exhausted batteries 25.

The spherical massage device 10 may be held between palms of the user and rotated by the relative movement between the palms to allow the nipple-like projections 13 to contact and massage the muscles of the palms and fingers. If desired, the user may turn on the vibration generator means 20 by using the switching button 27 to allow the spherical massage device 10 to vibrate and thus massage the hands that hold the spherical massage device 10.

It is apparent that although the invention has been described in connection with the preferred a embodiment, those skilled in the art may make changes to certain features of the preferred embodiment without departing from the scope of the invention as defined in the claims.

What is claimed is:

1. A spherical massage device adapted to be grasped in the hands of a user comprising a hollow spherical body defining an interior chamber and having a spherical outer surface on which a plurality of arcuately domed projections are uniformly distributed in closely spaced proximity each to the other and vibration generation means disposed within said interior chamber for imparting oscillatory motion to said projections which are adapted to be contiguously interfaced with the hands of the user, and switch means disposed within said interior chamber for selectively controlling energization and de-energization of said vibration generation means, said switch means including an actuating button extending from said interior chamber to a location internal one of said projections at a position accessible by an appendage of the user's hand to provide said energization and de-energization by displacement of said actuating button responsive to selective displacement of said one projection.

2. A spherical massage device as claimed in claim 1 wherein said spherical body comprises a first hemispheric shell having a lower opening on which an inner thread is formed and a second hemispheric shell having an upper opening on which an external thread is formed to be engageable with the inner thread of said first hemispheric shell to define said interior chamber therebetween.

3. A spherical massage device as claimed in claim 1 wherein said vibration generation means comprises a base plate fixed inside said interior chamber, said base plate having a first surface on which an electrical motor is fixed, said motor having a spindle on which an eccentric weight is mounted to be rotated by said motor in order to generate vibration, said base plate having a second surface, opposite to the first surface, on which a battery set is secured for supplying electricity to said motor under control of said switch means.

4. A spherical massage device as claimed in claim 1 wherein said one projection is particularly marked to indicate the location of said actuating button.

5. A spherical massage device as claimed in claim 4 wherein said particular mark comprises a color covering said one projection, said color of said one projection being distinguishable from a color of the others of said plurality of projections.

* * * * *